US008985761B2

(12) United States Patent
Wind

(10) Patent No.: US 8,985,761 B2
(45) Date of Patent: Mar. 24, 2015

(54) PRINTER ASSEMBLY

(71) Applicant: Oce-Technologies B.V., Venlo (NL)

(72) Inventor: Anne A. Wind, Eindhoven (NL)

(73) Assignee: Oce-Technologies B.V., Venlo (NL)

( * ) Notice: Subject to any disclaimer, the term of this patent is extended or adjusted under 35 U.S.C. 154(b) by 43 days.

(21) Appl. No.: 13/686,656

(22) Filed: Nov. 27, 2012

(65) Prior Publication Data

US 2013/0083114 A1 Apr. 4, 2013

Related U.S. Application Data

(63) Continuation of application No. PCT/EP2011/059129, filed on Jun. 1, 2011.

(30) Foreign Application Priority Data

Jun. 11, 2010 (EP) ..... 10165693

(51) Int. Cl.

| | |
|---|---|
| ***B41J 29/13*** | (2006.01) |
| ***B41J 29/02*** | (2006.01) |
| ***B41J 11/00*** | (2006.01) |
| ***B41J 15/04*** | (2006.01) |
| ***B41J 19/20*** | (2006.01) |

(52) U.S. Cl.

CPC ..... *B41J 29/023* (2013.01); *B41J 11/001* (2013.01); *B41J 15/04* (2013.01); *B41J 19/20* (2013.01)

USPC ..... 347/108

(58) Field of Classification Search

CPC ..... B41J 11/0045; B41J 15/04; B41J 13/00; B41J 13/0036

USPC ..... 347/16, 104, 108

See application file for complete search history.

(56) References Cited

U.S. PATENT DOCUMENTS

| | | | | |
|---|---|---|---|---|
| 4,992,805 | A | 2/1991 | Yoshizawa et al. | |
| 2005/0093954 | A1 | 5/2005 | Matsuo et al. | |
| 2006/0083564 | A1 * | 4/2006 | Yazawa et al. | 399/363 |

FOREIGN PATENT DOCUMENTS

| | | | |
|---|---|---|---|
| DE | 40 39 389 | A1 | 6/1992 |
| EP | 0 519 495 | A2 | 12/1992 |
| EP | 0 894 638 | A1 | 2/1999 |
| EP | 1 674 281 | A1 | 6/2006 |
| JP | 2-67139 | A | 3/1990 |
| JP | 2002-103717 | A | 4/2002 |
| WO | WO 99/64243 | A1 | 12/1999 |

* cited by examiner

*Primary Examiner* — Julian Huffman

(74) *Attorney, Agent, or Firm* — Birch, Stewart, Kolasch & Birch, LLP

(57) ABSTRACT

A printer assembly is configured to be arranged on a support surface and comprises: a medium delivery station and a printing station comprising a moveably arranged element. The printer assembly extends between a first end and a second end, wherein the printer is configured to be supported on the support surface at the first end. The medium delivery station and the printing station are arranged on a line extending between the first end and the second end. The printing station is arranged closer to the first end than the medium delivery station. A direction of movement of the moveably arranged element is not parallel to said line extending between the first end and the second end.

11 Claims, 5 Drawing Sheets

PRINTER ASSEMBLY

This application is a Continuation of PCT International Application No. PCT/EP2011/059129 filed on Jun. 1, 2011, which claims priority to Patent Application No. 10165693.2 filed in Europe on Jun. 11, 2010, all of which are hereby expressly incorporated by reference into the present application.

FIELD OF THE INVENTION

The present invention generally relates to a printer assembly and in particular to a printer assembly comprising a moveably arranged element.

BACKGROUND ART

Known printer assemblies are mounted on a support surface, for example a floor or a surface of a dedicated mounting structure, and have a moving element, for example a print head carriage moving along a recording medium for jetting droplets of a recording substance, e.g. ink, image-wise on the recording medium.

The recording medium is transported from a medium input station to a printing station, where the recording substance is provided on the medium, to a medium delivery station that is usually combined with the print station. During transport the medium needs to be aligned with the print head of the print station in order to prevent printing artifacts such to obtain a good image quality of the resulting printed image.

In a known printer assembly as e.g. disclosed in EP 1674281 A1, in particular a known wide-format printer assembly suitable for printing on roll fed recording media having a width of e.g. 16 inches or more, the medium input station and the print station are arranged above each other, the print station on top, in order to provide a printer assembly having a relatively small foot print, thus using a minimum of floor space. The printing station is arranged on top such that a user may take a printed medium at a comfortable user interaction position, i.e. at a position such that the user does not need to bend over or needs to get on his toes, or has to make any other non-desirable movement, for taking the printed medium.

In order to maintain alignment of the medium relative to the print head, at least a part of the frame construction of the known printer assembly is usually made relatively stiff such that the inertia forces resulting from the movement of the print head carriage do not disturb said alignment, resulting in a relatively expensive construction. In another approach as described in e.g. EP 1674281 A1 a particular two-fold structure of the frame construction is designed to prevent misalignment of recording medium and print head.

SUMMARY OF THE INVENTION

The present invention provides a printer assembly in which the frame construction may be made cost-effectively. According to the present invention, the printer assembly comprises a medium delivery station, a medium input station, and a printing station comprising a moveably arranged element. The printer assembly extends substantially vertically between a first end and a second end and the medium delivery station, the medium input station and the printing station are arranged along a line between the first end and the second end. The first end is configured to be supported on the support surface, while the printing station is arranged closer to the first end than the medium delivery station and closer to the first end than the medium input station.

A direction of movement of the moveably arranged element has at least a substantial horizontal component, i.e. is functionally intended not to be parallel to said substantially vertical line extending between the first end and the second end. Particularly, the horizontal component may be deemed substantial if the horizontal component results in a potential substantial movement of the printing assembly due to the inertia of the moving element. In any case, the horizontal component is at least substantial if the horizontal component of the movement is larger than the vertical component of the movement.

It is noted that the phrase 'extending substantially vertically' as used herein refers to an arrangement in which the separate modules/stations are arranged higher or lower than other modules/stations and for a relatively large part above or under the other modules/stations, but not necessarily exactly above one another and/or in an exactly straight line. Essentially, the vertically extending of the printer assembly is intended to provide a relatively small foot print by arranging the separate modules/stations substantially vertically.

The printer assembly is mounted on a support surface. Usually, the printer assembly is arranged on the support surface such that the printer assembly is not able to move and, hence, the frame construction of the printer assembly is presumed fixed (stationary) at the point of support on the support surface. In the above-described known, i.e. prior art, printer assembly, the moving element, in particular the relatively heavy print head carriage of the print station, is arranged on top of the printer assembly. As a result of the fixation at the first end of the frame construction, i.e. at the support surface, and a relatively large moving mass, in particular the print head carriage, at the second end, the whole frame construction tends to deform with the motion of the moving mass. In order to prevent such deformation of the frame construction, in the prior art, the frame is made stiff as above mentioned.

In the present invention, the moving element is arranged near the first end, i.e. near the end that is supported on the support surface and, thus, is fixed. Due to the relatively small distance between the point of fixation and the moving mass, the deformation is kept small, if any. Further, the part of the frame construction extending from the printing station to the second end will substantially not deform, since there is no moving mass at the second end. Consequently, the part of the frame construction extending between the printing station and the medium delivery station and/or medium input station is not required to be extraordinary stiff, enabling to use a more cost-effective frame construction.

Although it is common practice to position a printer assembly on a floor, the vertically arranged printer assembly according to the present invention may as well be mounted on a ceiling surface. In such embodiment, the printing station comprising the moveably arranged element should be provided close to the first end (the first end being the end close to the ceiling surface) such that the hanging printer assembly will not start swinging, when the printer assembly is operational.

Further, it is claimed that the printing station is closer to the first end than the medium input station and the medium delivery station, providing that any deformation of the frame construction may be limited to the frame construction between the first end and the printing station, which allows the frame construction for the part of the printer assembly extending from the printing station to the second end to be less stiff, while maintaining alignment of the recording medium and the printing station, which is of course desired for obtaining a suitable image quality of the resulting printed image. A particularly good and cost-effective result is obtainable when the printing station is arranged close to, and may be even preferably as close as possible to, the first end, since such positioning minimizes the requirements on the frame construction as a whole.

In an embodiment, the medium delivery station and the medium input station are each arranged on the line extending from the first end to the second end. This means that the medium delivery station and the medium input station are arranged one above the other. Such arrangement provides a small footprint of the printing assembly.

In an embodiment, the medium delivery station is arranged on the line extending between the first end and the second end at a user interaction position. In a relatively large printer assembly, such as a wide-format printer assembly as above described, it is desirable that a user has a simple and comfortable interaction with the assembly. A very common, probably most performed interaction between user and printer assembly is printed medium retrieval. The user usually sends a print job from a computer to the printer and the printed medium is then retrieved from the medium delivery station. Therefore, in this embodiment, the medium delivery station is arranged on a user-interaction position, which means that the medium delivery station is arranged such that most users do not have to bend or stretch in order to retrieve the printed medium. In particular, if the printer assembly is supported on a floor and users are intended to walk to the printer assembly and retrieve the printed medium in a standing position, the user interaction position may be arranged at a height above said floor of from about 0.75 m to about 1.5 m, preferably at a height of from about 0.9 m to about 1.1 m and even more preferably at a height of about 1 m.

In an embodiment, printer assembly further comprises a medium transport unit, wherein the medium transport unit is configured to transport the medium from the printing station to the medium delivery station. A medium printed on by the printing station is to be transported from the printing station to the medium delivery station. Since the printing station and the medium delivery station may be spaced apart, in an embodiment a specific medium transport unit may be provided to perform such transport. The medium transport unit may employ any suitable method using any suitable elements for transporting the medium. For example, the medium transport unit may comprise rollers, guides, belts, (air) pressure control devices or any other suitable conveying means.

The medium transport unit as described and claimed herein may be used to transport a printed medium to the medium delivery station arranged in the printer assembly. However, the medium transport unit may as well be configured and suited to transport a printed medium to an external finishing station such as a folding device, for example. The medium transport unit may be configured to deliver a printed medium to only a medium delivery station or an external finishing station or it may be configured to transport the printed medium to one of a number of stations depending on a user selection, for example.

In a particular embodiment, the medium transport unit comprises a medium guide means for guiding the medium towards the delivery station. As the printed medium is being delivered by the printing station, it is being pushed out of and away from the printing station. Using suitable guide means such as a guide rail, guide rollers, and the like, the medium may be guided towards the medium delivery station.

In another particular embodiment, the medium transport unit comprises a nip for engaging the medium and for transporting the medium towards the medium delivery station. Note that the term 'nip', as used herein, refers to any suitably clamping structure suited for transporting a printed medium. In such embodiment comprising a nip, possibly also comprising (other) guide means, the nip is arranged for receiving a portion of the printed medium and engaging said portion. If the nip comprises two rollers for engaging the printed medium, at least one of said two rollers being driven, the printed medium may be transported through said nip. In a particular embodiment, the nip is moveably arranged for moving from an output terminal of the printing station to an input terminal of the delivery station such that the nip is configured to

- engage a portion of the medium at the output terminal of the printing station;
- hold the medium while moving to the input terminal of the delivery station; and
- disengage said portion of the medium at the input terminal of the delivery station.

Thus, in such embodiment, the nip may pull or push, for example by clamping and moving, the printed medium from an output terminal of the printing station, i.e. a location of the printing station where the printed medium is output, to a medium input terminal of the medium delivery station, i.e. a location of the medium delivery station where a printed medium is to be delivered for delivery to the user.

In an embodiment, the delivery station is configured to receive a number of printed mediums on a stack and to position a leading edge of each respective printed medium in the stack at a predetermined delivery position, wherein the predetermined delivery position is dependent on the respective paper size. In such embodiment, a user is enabled to easily retrieve a printed medium resulting from his print job from a pile of printed mediums e.g. resulting from print jobs of other users. In the prior art all printed mediums, irrespective of their size, are delivered on a single pile with their leading edges at the same position, thereby burying small papers, while in this embodiment, a leading edge of small papers may be positioned at a position closer to a user than the leading edge of a larger paper, for example. Thus, small papers may be easily retrieved from the pile. It is noted that the use of this delivery method is not limited to use in a printer assembly according to the present invention, but may as well be advantageously employed in any other printer assembly.

In an embodiment, the printer assembly further comprises a medium input station, the medium input station being arranged on the line extending between the first end and the second end. Such a medium input station may be configured to hold a pile of unprinted mediums and/or may be configured to hold a roll of medium and/or may be configured to receive a single medium, such as a sheet of paper and/or may comprise any other suitable medium input means. In either case, the medium input station may be arranged between the printing station and the medium delivery station or the medium input station may be arranged closer to the second end than the medium delivery station. Preferably, the printing station is closer to the first end than the medium input station in order to have as little frame deformation due to the moving of the moving element as above elucidated. Further, it may be assumed that a user has more interaction with the medium input station than with the printing station. Therefore, it may be desirable to have the medium input station closer to a user interaction position, as above defined, than the printing station.

In an embodiment, the printer assembly further comprises a scanning device for scanning an original image medium, the scanning device being arranged on the line extending between the first end and the second end.

In an embodiment, the printer assembly further comprises a scanning device for scanning an original image medium, wherein the scanning device is arranged on the line extending between the first end and the second end and wherein the medium transport unit is further configured to receive an original image medium and to transport the original image medium to the medium delivery station. In a particular embodiment, the delivery station is configured to receive a number of mediums on a stack and to position a leading edge of each respective medium in the stack at a predetermined delivery position, wherein the predetermined delivery position is dependent on a type of the medium, the type being selected from a group of types comprising a printed medium originating from the print station and an original image medium originating from the scanning device.

Further scope of applicability of the present invention will become apparent from the detailed description given hereinafter. However, it should be understood that the detailed description and specific examples, while indicating embodiments of the invention, are given by way of illustration only, since various changes and modifications within the scope of the invention will become apparent to those skilled in the art from this detailed description.

BRIEF DESCRIPTION OF THE DRAWINGS

The present invention will become more fully understood from the detailed description given hereinbelow and the accompanying schematical drawings which are given by way of illustration only, and thus are not limitative of the present invention, and wherein.

DETAILED DESCRIPTION OF THE DRAWINGS

Figure 1:
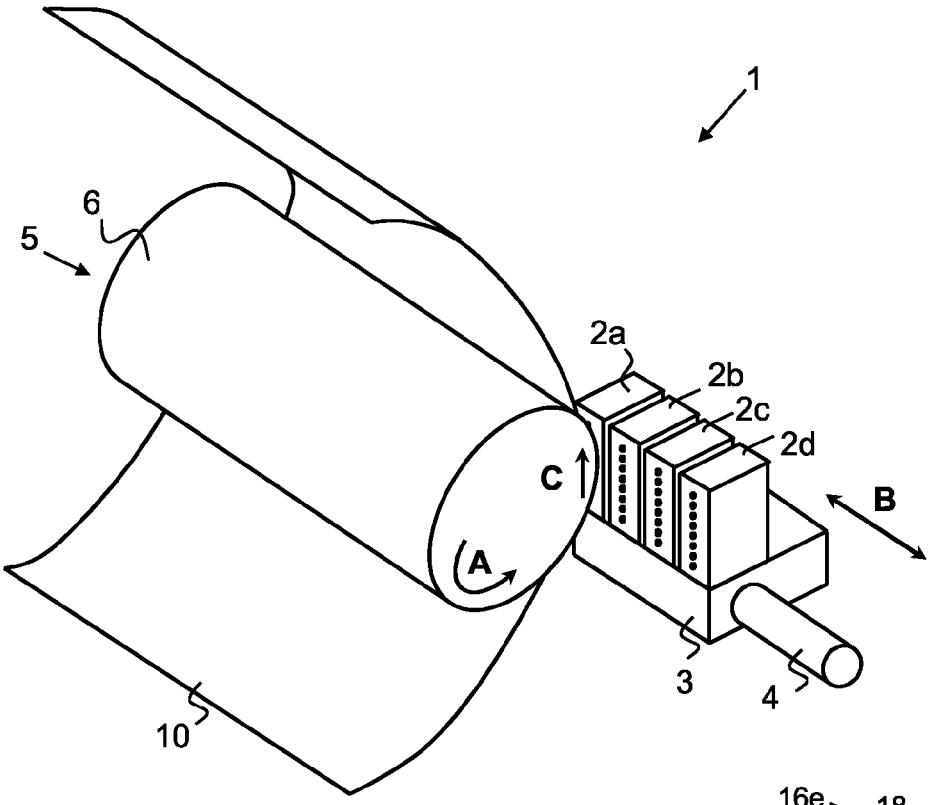
FIG. 1 is a schematical representation of a scanning inkjet printing process.

The present invention will now be described with reference to the accompanying drawings, wherein the same reference numerals have been used to identify the same or similar elements throughout the several views. Further, it is noted that the drawings are intended to illustrate the present invention. Therefore, for clarity reasons, certain structural elements, e.g. a support structure, may be omitted, although such elements may be required in practice. A person skilled in the art recognizes the omission of such elements and is enabled to provide such elements in a practical embodiment.

FIG. 1 schematically represents a typical set-up of a scanning-type ink jet printer 1. The ink jet printer 1 comprises a number of multi-nozzle print heads 2*a*-2*d*, each provided with an ink of a respective color, for example cyan, magenta, yellow and black. The print heads 2*a*-2*d* are mounted on a carriage 3 which is guided on at least one guide rail 4. In operation, the carriage 3 travels forth and back along the guide rail 4. The movement of the carriage 3 is substantially parallel to a recording medium 10 (e.g. paper) in a direction B, so that an image swath (i.e. an image strip usually comprising multiple parallel dot lines) is printed on the medium 10 in each pass of the print heads 2*a*-2*d*.

A medium support unit 5 having a feed roller 6 on which the recording medium 10 is mounted is provided. The medium support unit 5 comprises rotating means, for example a worm wheel mounted on an axle (not shown) of the feed roller 6. A worm (not shown) is mounted to mesh with the worm wheel and is driven by an electric motor (not shown). When the feed roller 6 is rotated in the direction of the arrow A, the recording medium 10 is advanced relative to the print heads 2*a*-2*d* in the direction represented by the arrow C. The direction C is usually referred to as the sub-scanning direction of the printer 1, and the direction B is usually referred to as the main scanning direction, i.e. the direction in which the print heads 2*a*-2*d* move back and forth. A camera (not shown) may be mounted on the carriage 3 for imaging an area on the recording medium 10, e.g. an area just provided with dots of ink for print quality control.

A printer control unit (not shown) may control the feed roller 6 so as to advance the recording medium 10 by a required length, once the carriage 3 carrying the print heads 2*a*-2*d* has performed a pass across the recording medium 10 during which pass the print heads 2*a*-2*d* are controlled to provided dots of ink corresponding to an image to be printed. After such an image swath has been printed, the recording medium 10 may be controlled to be advanced by a length substantially equal to a width of the image swath, so that the next image swath may be printed adjacently.

For printing on a relatively large recording medium, such as a medium of size A0, in particular having a relatively large width, e.g. 24 inch or larger, the printer 1 may be provided with more than the four print heads 2*a*-2*d*. In known wide-format printers, the carriage 3 may carry 10 or even more print heads. Each print head is provided with an amount of ink and the carriage 3 is usually constructed to be stiff. All together, the weight of the carriage 3 including the print heads 2*a*-2*d* may be relatively high. The scanning movement in direction B results therefore in considerable inertia forces. These inertia forces become even more pronounced when the printer 1 is configured to print at a high speed, requiring high speed movement of the carriage 3 during printing and requiring quick turning of the carriage 3 after each swath, thereby requiring high accelerations. In accordance with the present invention and as shown in FIG. 2, in a printer 1, the large, moving mass of the carriage 3 is arranged close to a support surface 11.

Figure 2:
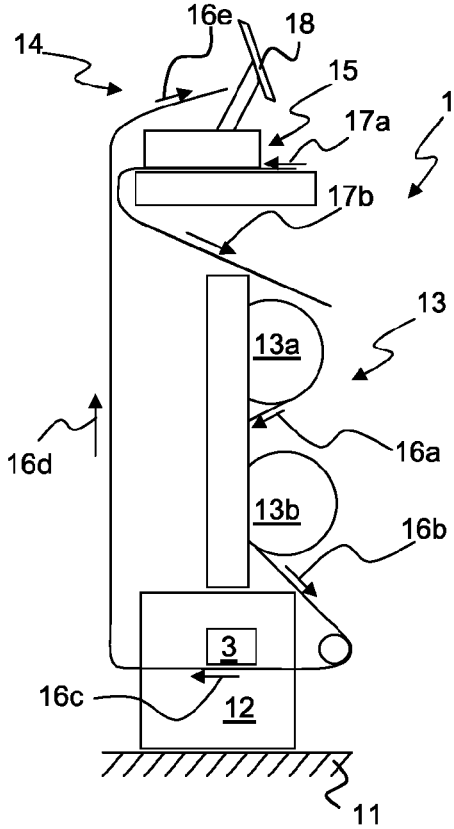
FIG. 2 schematically illustrates a first embodiment of a printer assembly according to the present invention.

FIG. 2 schematically illustrates an exemplary embodiment of a printer 1 according to the present invention. The printer 1 comprises a printing station 12, a medium input station 13, a medium output station 14 and a scanning station 15. The printer 1 further comprises a user operating panel 18. Of course, not all stations 12-15 and 18 are required for performing the present invention. The printer 1 is arranged on the support surface 11.

The printer 1 extends from a first end located near the support surface 11 and a second end at which in this embodiment the user operating panel 18 is arranged. The printer 1 may thus be positioned on the support surface 11 while supported at the first end. The printing station 12, the medium delivery station 14 and in this embodiment also the medium input station 13 and the scanning station 15 are arranged on a line extending from the first end to the second end, while the printing station 12 is arranged closer to the first end compared to the position of the medium delivery station 14 relative to the first end.

The shown embodiment of the printer 1 is provided with a medium input station 13 comprising two rolls 13*a*, 13*b* of web of recording medium, e.g. paper, but other kinds of medium are envisaged as well. The web is fed along a recording medium path 16*a*-16*e*. The first roll 13*a* comprises a first web and the second roll comprises a second web. The first web may be fed via the medium input station 13 to the printing station 12 as indicated by the arrows 16*a* and 16*b*. Instead of the web of the first roll 13*a*, the web of the second roll 13*b* may be fed to the printing station 12 in accordance with the path indicated by arrow 16*b*. The web is fed from the medium input station 13 to the printing station 12 and is fed through the printing station 12 as indicated by arrow 16*c*. In the printing station 12 an image may be provided on the recording medium. The recording medium output by the printing station 12 is then guided to the medium delivery station 14, which in this embodiment is provided on top of the printer 1, as indicated by the arrows 16*d* and 16*e*.

The illustrated embodiment further comprises the scanning station 15. The scanning station 15 is embodied as a feed-through scanner which is suitable for scanning a large original medium. An original medium may be fed into the scanning station as indicated by arrow 17*a*. The original medium may then be transported through the scanner and into a receiving tray, guiding the original medium, as indicated by arrow 17*b*. It is noted that, in another embodiment, the original medium path 17*a*, 17*b* may be oppositely directed, i.e. the original medium being input at the location of arrow 17*b* and being transported to and through the scanner, and leaving the scanning station 15 at the location of the arrow 17*a*.

In the illustrated embodiment, the printing station 12 comprises a moveably arranged carriage 3 configured for high speed printing, resulting in considerable inertia forces in a direction perpendicular to the plane of the drawing. In order to prevent that a frame assembly of the printer 1 is required to be stiff to prevent the inertia forces to influence the print quality, the printing station 12 is arranged close to the support surface 11. Due to friction (or any other suitable force counteracting the inertia forces) between the printer 1 and the support surface 11, any movement of the printing station 12 due to the inertia forces is limited. Further, if any movement of the printing station 12 remains, the medium input station 13 and the medium output station 14 move with the printing station 12, thereby further limiting any influence of the inertia forces on the resulting print quality. It is noted that, although preferred, the printing station 12 is not required to be arranged at the support surface 11. A distance between the support surface 11 and the printing station 12 may be provided by a frame assembly of the printer 1.

In the present invention, the printing station 12 comprises a moveably arranged element. The moveably arranged element may be the carriage 3 of a scanning type inkjet printing assembly. However, in another embodiment, the moveably arranged element may be any other kind of element, for example a medium cutting knife assembly for cutting a web after printing. In other embodiments, other moving elements may be provided.

With respect to usability of the printer 1, it is considered that the wide-format printer 1 is arranged on a floor (support surface 11) and has a height such that the user operating panel 18, the medium delivery station 14 and the scanning station 15 are arranged on a user interaction position on the line extending between the first end and the second end. The user interaction position is a position, in this embodiment a height above the floor, that is easily approachable for most users, that means without bending or stretching, or the like. Moreover, the illustrated embodiment is arranged such that any user has a minimum of bending and/or stretching in operating the printer 1, which is based on the following considerations. A largest number of interactions of a user with the printer 1 is retrieval of a printed medium, which is delivered at the medium delivery station 14 at a user interaction position. Secondly, a less number of interactions of the user concern scanning of originals. Thirdly, an even less number of interactions is performed for replacing the medium input rolls. Fourthly, only once in a while, a user may need to replace a print head, or the like, requiring interaction with the printing station 12. Note that an ink reservoir may be arranged at a distance from the print head and may also be arranged in the printer assembly at a suitable user interaction height. Thus, having the medium delivery station 14 at the user interaction position results in a user-friendly arrangement of the respective stations of the printer 1.

For transporting the medium from the printing station 12 to the medium delivery station 14 as indicated by arrow 16*d*, a medium transport unit may be provided. The medium transport unit may be a guiding assembly, e.g. two plates arranged close to each other and extending from the printing station 12 to the medium delivery station 14 such that a medium being provided between the two plates is guided and pushed by the printing station 12 to the medium delivery station 14. Such an embodiment is simple and cost-effective. In another embodiment, such guiding plates may be accompanied by feed rollers, conveyor means, transporting bands, or the like, thereby not only relying on passively guiding the medium 20, but also actively transporting the medium 20. An embodiment of a specific, sophisticated medium transport unit is illustrated in FIG. 3A-3D.

The illustrated embodiment of the printer 1 in FIGS. 3A-3D comprises the printing station 12 and the medium delivery station 14. A web-based medium 20 is provided on a the medium input roll 13*b* and is fed into the printing station 12 at a printing station input terminal 21. In the printing station 12, the medium 20 is guided such that the carriage 3 is enabled to move in parallel and to image-wise provide droplets of inks in swaths. Further, the medium 20 is guided along a cutting assembly 23 configured to cut the web of the medium 20. The cutting assembly is arranged close to a printing station output terminal 22. Outside the printing station 12, near the output terminal 22 thereof, a nip 24 is provided. The nip 24 is moveably arranged such that the nip 24 may move towards the medium delivery station 14 guided by a suitable guiding means 25.

Figure 3A:
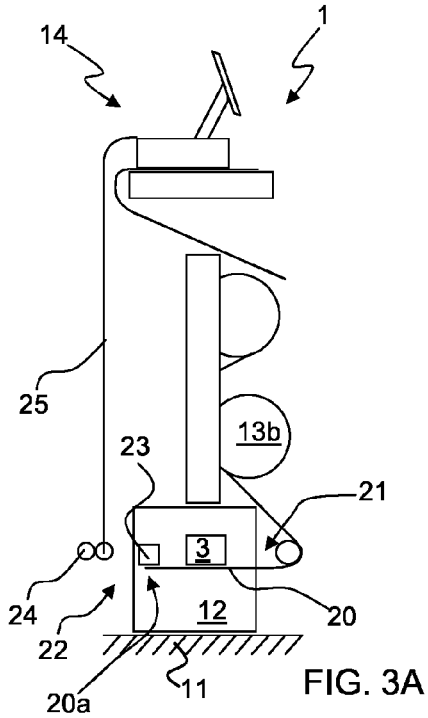
FIG. 3A-3D illustrate an exemplary method for transporting a recording medium in the printer assembly according to FIG. 2.
Figure 3B:
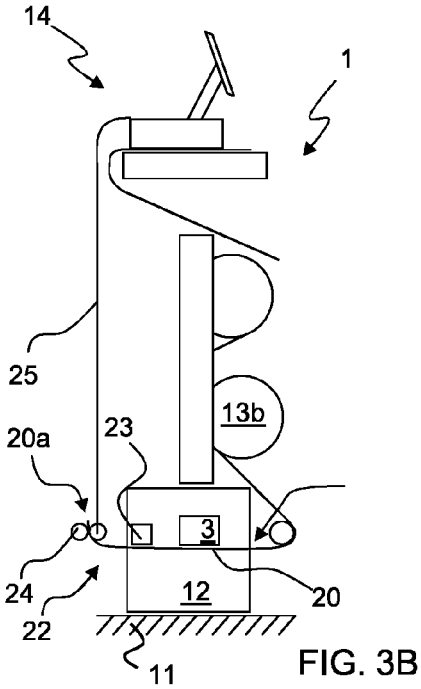

FIG. 3A illustrates a starting position of the printer 1 prior to printing an image on the recording medium 20. A leading edge 20*a* of the recording medium 20 is located at the cutting assembly 23. The printer 1 may start printing on the medium 20. When printing an image on the medium 20, the medium 20 is pushed outward with every swath of the printing station 12, thereby step-wise leaving the printing station at the printing station output terminal 22.

The leading edge 20*a* of the medium 20 eventually arrives at the nip 24 of the medium transport unit. The leading edge 20*a* may be guided by guiding means or the nip 24 may be arranged such that the leading edge 20*a* inevitably arrives in the nip 24. In any case, the nip 24 is arranged and configured to engage the leading edge 20*a* and pull the leading edge 20*a*, and thereby the medium 20, towards the medium delivery station 14. Of course, the nip 24 engaging a leading edge 20*a* of the medium 20 is merely an embodiment. In another embodiment, the nip 24 may be configured to engage any other suitable portion of the recording medium 20, for example depending on the position at which the medium 20 has to be provided in the medium delivery station 14, as is described below in relation to FIG. 4.

Having engaged the medium 20, the nip 24 may move towards the medium delivery station 14 in steps corresponding to the width of the image swath being printed by the printing station 12. In order to prevent any undesired tension in the medium web a curl or blouse may be provided near the printing station output terminal 22, but such a curl may not be required.

Figure 3C:
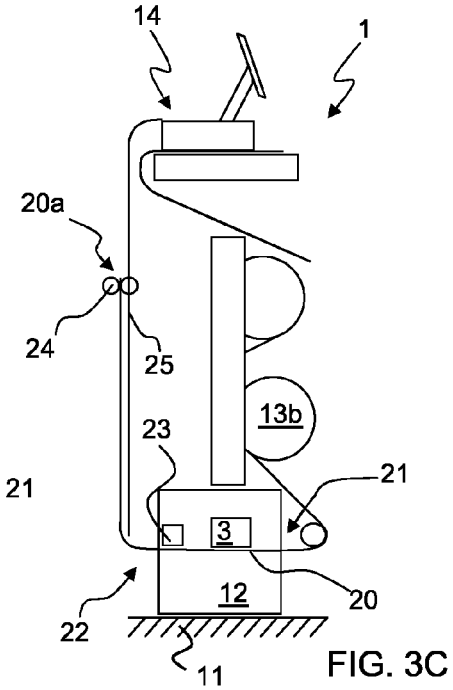

In FIG. 3C the nip 24 is advanced towards the medium delivery station 14. At this position, it is assumed that the printing station 12 has finished printing the image and the image, and hence the print, is completed. Therefore, at this position, the cutting assembly 23 is controlled to cut the web of the medium 20. After cutting, the nip 24 may transport the leading edge 20*a* to the medium delivery station 14.

Figure 3D:
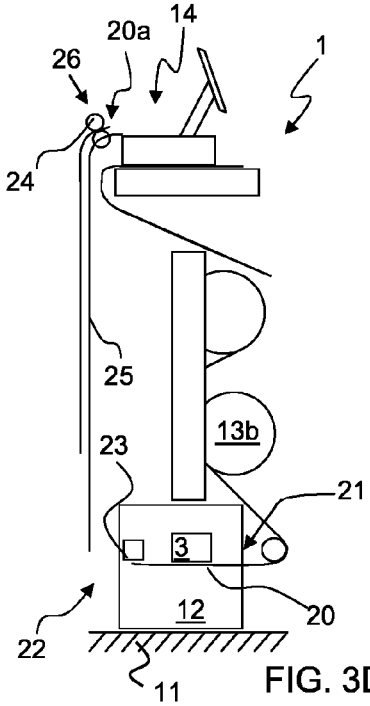

FIG. 3D illustrates a position of the nip 24 at a medium delivery station input terminal 26 the medium delivery station 14, wherein the leading edge 20*a* of the medium 20 is delivered at the medium delivery station 14. Having delivered the leading edge 20*a* of the medium 20 at the delivery station 14 such that the leading edge 20*a* of the medium 20 will remain there, the nip 24 may disengage the medium 20 and return to the printing station output terminal 22.

It is noted that the use of the embodiment of a medium transport unit as illustrated in and described in relation to FIGS. 3A-3D is not limited to the illustrated and described application and the medium transport unit may as well be employed in an apparatus other than a printer and may as well be employed in another kind of printer for suitably transporting a recording medium or any other medium, for example a sheet-like photoconductor as used in a printer based on electro-photography.

Figure 4:
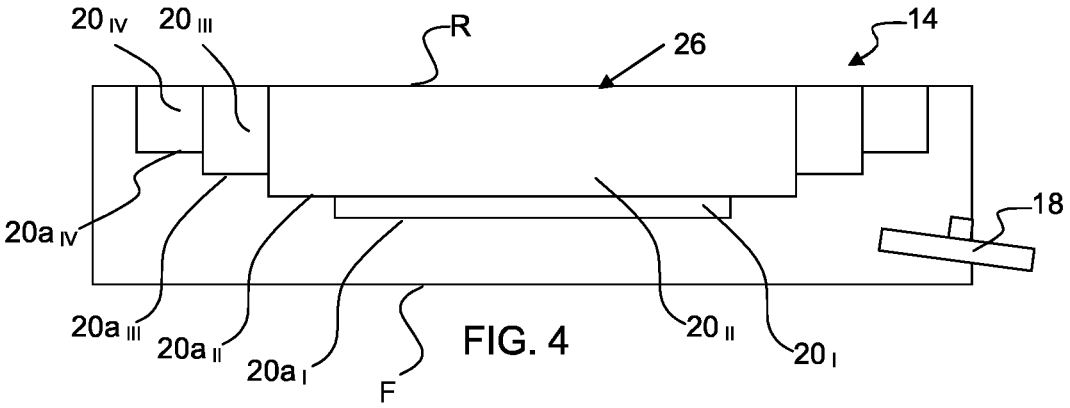
FIG. 4 illustrates an exemplary method for delivering recording mediums in an delivery station of a printer assembly.

FIG. 4 illustrates a particular embodiment of the printer 1 as illustrated in FIGS. 3A-3D. The printer 1 of FIGS. 3A-3D is suited for printing on a number of differently sized media. For example, the printer 1 may be enabled to print on a medium having a width of 28 inch. Usually, such a printer 1 is then enabled to print on a medium having a smaller width, e.g. 24 inch, as well. When different medium sizes are intermingled in operation and the printed media are stacked in the medium delivery station 14, a user may find it difficult to retrieve his small sized print from the stack.

FIG. 4 shows in a top view the operator panel 18 and the medium delivery station 14, which, in the illustrated embodiment, is a tray-like position for generating a stack of printed media $\mathbf{20}_I$-$\mathbf{20}_{IV}$. A printed medium $\mathbf{20}_{II}$ lies on top of the stack, while printed media $\mathbf{20}_I$, $\mathbf{20}_{III}$ and $\mathbf{20}_{IV}$ are arranged thereunder. In the medium delivery station 14 the leading edge $\mathbf{20}a_I$-$\mathbf{20}a_{IV}$ of each printed medium $\mathbf{20}_I$-$\mathbf{20}_{IV}$ is positioned at a predetermined position, wherein said predetermined position is determined based on and is dependent on the width of the printed medium $\mathbf{20}_I$-$\mathbf{20}_{IV}$.

As illustrated in FIG. 3D, a printed medium 20 is transported to the medium delivery station 14 at a rear side R (i.e. a side opposite from a front side F at which side an operator operates the printer 1) and supplies the printed medium 20 to the medium delivery station 14 at the medium delivery station input terminal 26. Based on the size of the input medium, e.g. derivable from the roll of the medium input station 13 used, the printer control unit (not shown) controls the medium transport unit and/or the medium delivery station 14 to transport the leading edge 20*a* to a position corresponding to a position that is predetermined and corresponds to the size of the medium 20. For example, referring to FIG. 4, the leading edge 20*a*, of a medium having relatively small width, e.g. medium $\mathbf{20}_I$, is positioned close to the front side F, while the leading edge $\mathbf{20}a_{IV}$ is positioned closer to the rear side R. Consequently, the relatively small medium $\mathbf{20}_I$ extends from a front of the stack and may thus be easily retrieved, while the relatively wide medium $\mathbf{20}_{IV}$ extends from a side of the stack and may thus be easily retrieved.

Positioning of the leading edge of a medium may be performed by the medium delivery station 14, provided that the medium delivery station 14 is provided with suitable means for engaging and positioning a medium. In another embodiment, positioning may be performed by the nip 24 (FIGS. 3A-3D). For example, as suggested above, the nip 24 may be configured and/or controlled to engage the medium 20 at a position such that the medium 20 will be correctly positioned once the nip 24 disengages at the medium delivery station input terminal 26. In another embodiment the nip 24 may be provided with a spooling function. For example, the nip 24 as illustrated comprises two rollers. If one or both of said rollers is coupled to a drive unit, e.g. a motor, such that at least one of the rollers may be driven to rotate, the nip 24 may be enabled to spool the medium 20 forward or backward, thereby enabling the nip 24 to position the leading edge 20*a* at the predetermined position. Any other suitable means for positioning the medium and/or the leading edge of the medium at the predetermined position may be employed as well.

Figure 5A:
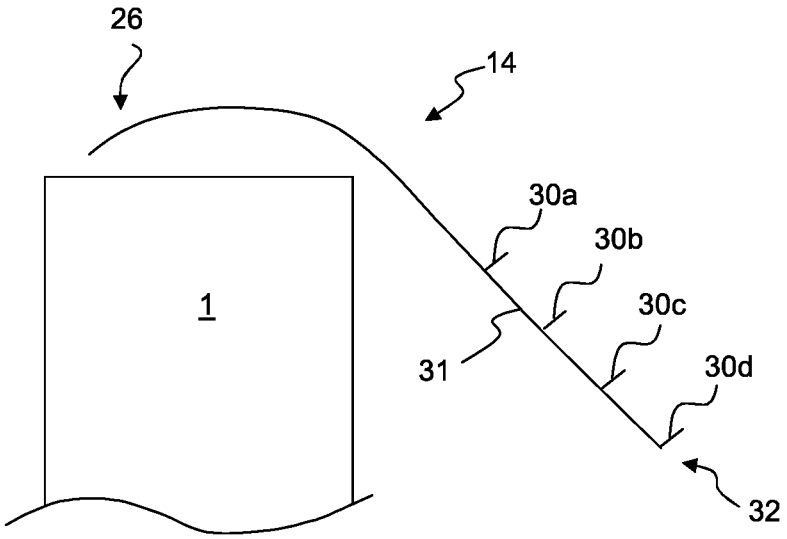
FIG. 5A-5B show a side view and a top view, respectively, of an embodiment of a medium delivery station configured to perform the method illustrated in FIG. 4.
Figure 5B:
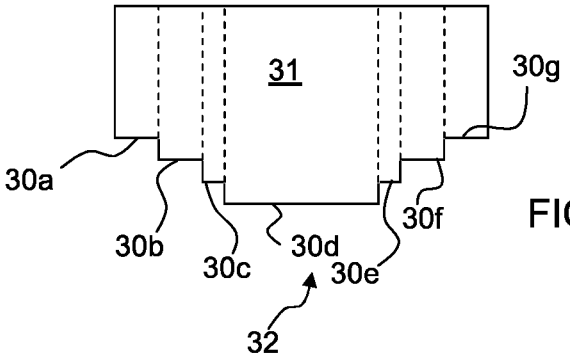

FIGS. 5A and 5B schematically illustrate a simple embodiment of a medium delivery station 14, in which delivered printed mediums are sorted in accordance with the method as described in relation to and illustrated in FIG. 4. FIG. 5A shows in a side view a medium delivery tray 31 arranged such that a medium may be guided and transported, by the force of gravity or suitable transporting means provided in the medium delivery station, from the medium delivery station input terminal 26 to a position on the medium delivery tray 31. Referring to both FIGS. 5A and 5B (top view), the medium delivery tray 31 is provided with a number of suitably arranged ridges 30*a*-30*g* defining a number of suitably arranged associated medium delivery locations 32*a*-32*d*. In particular, as seen from FIG. 5B, the ridges 30*a*-30*g* do not extend over the full width of the medium delivery tray 31. A first ridge 30*a* is arranged at a first position along a front side 32 of the medium delivery tray 31 and extends over a small part of the width of the medium delivery tray 31. A corresponding seventh ridge 30*g* is positioned at a seventh position along the front side 32 of the medium delivery tray 31. Wide mediums, i.e. mediums having a width larger than a space between the first and the seventh ridge 30*a* and 30*g*, engage with the first and seventh ridge 30*a* and 30*g* when they are transported towards the front side 32 of the medium delivery tray 31. Mediums having a smaller width move further towards the front side 32 and, depending on their width, engage with the second and sixth ridges 30*b* and 30*f* or with the third and fifth ridges 30*c* and 30*e* or with the fourth ridge 30*d*. Thus, very small mediums engage with the fourth ridge 30*d* and thus protrude at the front side 32 from a pile of mediums arranged on the medium delivery tray 31, while mediums having a larger width protrude from the pile at their side edges.

The illustrated and above-described embodiment of a medium delivery tray 31 presumes that the printer assembly 1 transport the mediums in a centered way, i.e. each medium, irrespective of its width, is positioned in the center of the printer assembly 1. However, in other embodiments, the mediums may be positioned differently. So, the number, the width and the position of the ridges 30*a*-30*g* may differ from the illustrated embodiment depending on the configuration of the printer assembly 1. In a particular embodiment, the ridges are removably attached and may be positioned by a user depending on the different mediums frequently used by that user, allowing the user to determine the delivery position for those frequently used mediums.

Figure 6:
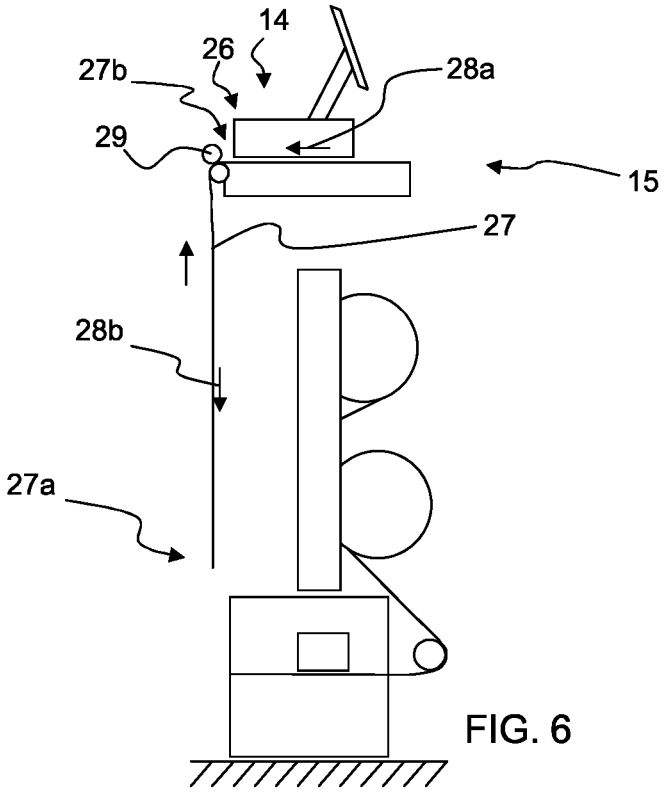
FIG. 6 illustrates an exemplary method for delivering an original medium in the printer assembly according to FIG. 2.

FIG. 6 illustrates a further embodiment, in which an original medium 27 fed through the scanning station 15 is transported and delivered in the medium delivery station 14. In the illustrated, particular, exemplary embodiment, the original medium 27 is transported through the scanning unit 15 in accordance with arrow 28*a* and the leading edge 27*a* of the original medium 27 moves towards the printing station 12 in accordance with arrow 28*b*, for example guided by the force of gravity, through a nip 29. The nip 29 may engage the original medium 27 and actively support the movement of the original medium 27 or the nip 29 may be opened, thereby only passively guiding the original medium 27. In any case, as soon as a trailing edge 27*b* approaches the nip 29, the original medium 27 is engaged by the nip 29 and the nip 29 is configured and arranged to transport the trailing edge 27*b* to the medium delivery station input terminal 26. The medium delivery station 14 thus receives the trailing edge 27*b* of the original medium 27 enabling the medium delivery station 14 to deliver the original medium 27 to the operator.

Figure 7:
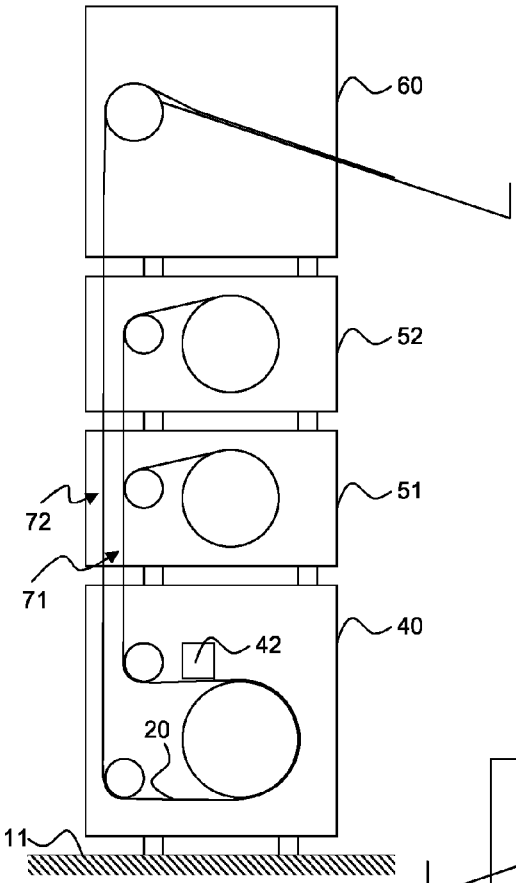
FIG. 7 illustrates a second embodiment of a printing assembly according to the present invention comprising stackable modules.

FIG. 7 illustrates a single footprint printing assembly comprised of four stackable modules: a printing station 40, a first medium input station 51, a second medium input station 52 and a medium delivery station 60. The four modules are stacked on top of each other, wherein the printing station 40 is arranged closest to the support surface 11. The printing station 40 comprises a moveably arranged carriage 42 for printing on the medium 20. The forces of inertia resulting from the movement of the carriage 42 are absorbed by a relatively stiff frame construction of the printing station 40. This allows that any other module may be stacked on top of the printing station 40. While in the prior art such stackable arrangement would require specific measures to obtain a sufficiently stiff arrangement, the stacked printer assembly in accordance with the present invention does not require such stiff construction and enables a cost-effective modular printer assembly. The vertically arranged and stacked printer assembly is particularly advantageous for use with wide-format printer assemblies in order to keep the required floor space (foot print) small, while providing a large range of possible configurations and enabling a free choice for desired functionality.

The modular printer assembly as illustrated in FIG. 7 may of course be further extended by stacking further medium input stations and/or further medium delivery stations. Note that a medium delivery station may include a finishing assembly such as a folding assembly, for example. In order to be able to stack multiple stations, each module should comply with certain design rules, such as dimensions. A particular design rule relates to the medium transport means, which should be coupled to enable transport of the medium from one station to the next. Thereto, a standardized mechanical coupling interface and/or a standardized electrical coupling interface may be defined and employed. Moreover, due to the vertical arrangement having the printing station 40 near the support surface, a module arranged between two other modules, e.g. the first medium input station 51, may need to provide an input transport path 71 and a delivery transport path 72 such that an input medium originating from the second medium input station 52 may be transported to the printing station 40 and a printed medium may be transported to the medium delivery station 60.

Figure 8:
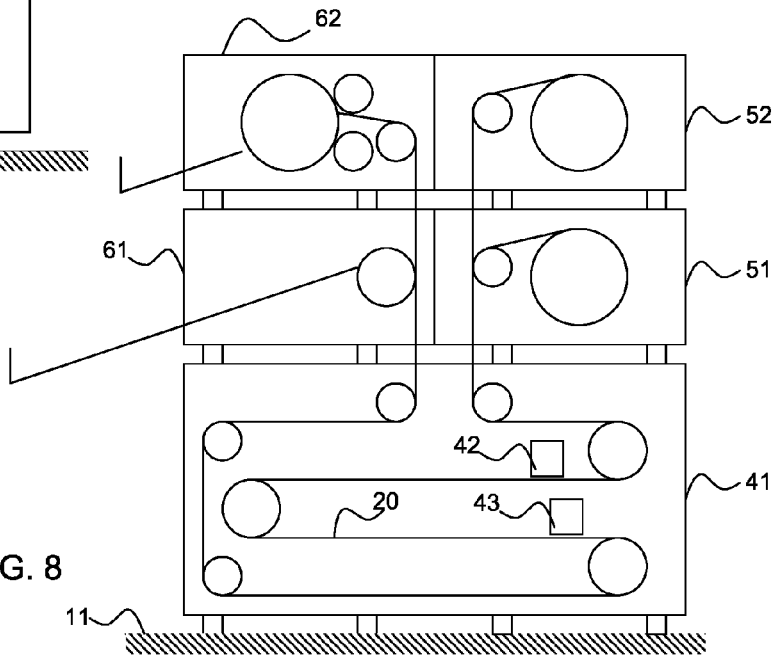
FIG. 8 illustrates a third embodiment of a printing assembly according to the present invention comprising stackable modules.

While FIG. 7 illustrates a printer assembly according to the present invention, in which the medium input stations 51, 52 and the medium delivery station 60 arranged on a virtual vertical line extending from the first end at the support surface 11 to the second end at the medium delivery station 60, FIG. 8 shows an alternative embodiment including a duplex printing station 41 having the medium input stations 51, 52 and two medium delivery stations 61, 62 arranged along a vertical line. The duplex printing station 41 includes two moveably arranged carriages 42, 43, each one for printing on a respective side of the medium 20 and includes a suitable trajectory for the medium 20 to enable ink to dry after printing and before coming into contact with a guiding roller, or the like. As a result, the duplex printing station 41 has been configured to have a footprint that is twice the size of the footprint of the simplex printing station 40 (see FIG. 7). Using the same medium input stations 51, 52 is enabled by suitable arrangement of the mechanical and electrical coupling interfaces. FIG. 8 shows further suitable modules for use in the stackable vertically arranged printer assembly, such as the medium delivery station 61 at half the height of the medium delivery station 60 and a folding station 62.

The medium input stations 51, 52 and the medium delivery stations 61, 62 are arranged back to back along the vertical line extending between the first end of the printer assembly at the support surface 11 and the second end at the top of the printer assembly. In an embodiment, these stations 51, 52, 61, 62 are not required to be arranged back to back, but a small distance between the stations 51, 52, 61, 62 is also deemed to be included in the phrase "along the vertical line".

Further, note that in a duplex printing station 42 as illustrated, the two moveably arranged carriages 42, 43 may be controlled to move simultaneously in opposite directions, thereby counteracting each others forces of inertia and thus further decreasing any forces in the horizontal direction.

Detailed embodiments of the present invention are disclosed herein; however, it is to be understood that the disclosed embodiments are merely exemplary of the invention, which can be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure. In particular, features presented and described in separate dependent claims may be applied in combination and any combination of such claims are herewith disclosed.

Further, the terms and phrases used herein are not intended to be limiting; but rather, to provide an understandable description of the invention. The terms "a" or "an", as used herein, are defined as one or more than one. The term plurality, as used herein, is defined as two or more than two. The term another, as used herein, is defined as at least a second or more. The terms including and/or having, as used herein, are defined as comprising (i.e., open language). The term coupled, as used herein, is defined as connected, although not necessarily directly.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

The invention claimed is:

1. Printer assembly configured to be arranged on a support surface, the printer assembly comprising:

a medium delivery station;

a medium input station; and a printing station comprising a moveably arranged element;

wherein the printer assembly extends vertically between a first end and a second end, the printer being configured to be supported on the support surface at the first end;

the printing station is arranged closer to the first end than the medium delivery station and closer to the first end than the medium input station, a direction of movement of the moveably arranged element has at least a substantial horizontal component, and the medium delivery station, the medium input station and the printing station are arranged along a line vertically extending between the first end and the second end such that a foot-print of the printer assembly is not substantially larger than a largest foot-print of the medium input station, the medium delivery station and the printing station.

2. Printer assembly according to claim 1, wherein the medium delivery station is arranged along the line extending between the first end and the second end at a user interaction position.

3. Printer assembly according to claim 1, wherein the printer assembly further comprises a medium transport unit, the medium transport unit being configured to transport the medium from the printing station to the medium delivery station.

4. Printer assembly according to claim 3, wherein the medium transport unit comprises a medium guide means for guiding the medium towards the delivery station.

5. Printer assembly according to claim 3, wherein the medium transport unit comprises a nip for engaging the medium and for transporting the medium towards the medium delivery station.

6. Printer assembly according to claim 5, wherein the nip is moveably arranged for moving from an output terminal of the printing station to an input terminal of the delivery station such that the nip is configured to engage a portion of the medium at the output terminal of the printing station;

hold the medium while moving to the input terminal of the delivery station; and disengage said portion of the medium at the input terminal of the delivery station.

7. Printer assembly according to claim 1, wherein the delivery station is configured to receive a number of printed mediums on a stack and to position a leading edge of each respective printed medium in the stack at a predetermined delivery position, wherein the predetermined delivery position is dependent on the respective paper size.

8. Printer assembly according to claim 1, wherein the printer assembly further comprises a scanning device for scanning an original image medium, the scanning device being arranged on the line extending between the first end and the second end and the printing station is arranged closer to the first end than the scanning device.

9. Printer assembly according to claim 3, wherein the printer assembly further comprises a scanning device for scanning an original image medium, the scanning device being arranged on the line extending between the first end and the second end and closer to the second end than the printing station and wherein the medium transport unit is further configured to receive an original image medium and to transport the original image medium to the medium delivery station.

10. Printer assembly according to claim 9, wherein the delivery station is configured to receive a number of mediums on a stack and to position a leading edge of each respective medium in the stack at a predetermined delivery position, wherein the predetermined delivery position is dependent on a type of the medium, the type being selected from a group of types comprising a printed medium originating from the print station and an original image medium originating from the scanning device.

11. Printer assembly according to claim 1, wherein the medium input station includes rollers configured to feed a medium into the printing station, the medium delivery station, the medium input station and the printing station are arranged along a longitudinal axis of the printer assembly, said longitudinal axis being orthogonal to the support surface.

* * * * *